United States Patent [19]

Lapatovich et al.

[11] Patent Number: 4,672,267

[45] Date of Patent: Jun. 9, 1987

[54] HIGH INTENSITY DISCHARGE DEVICE CONTAINING OXYTRIHALIDES

[75] Inventors: Walter P. Lapatovich, Hudson; William M. Keeffe, Rockport; Richard W. Liebermann, Danvers; Jakob Maya, Brookline, all of Mass.

[73] Assignees: GTE Laboratories Incorporated, Waltham; GTE Products Corporation, Danvers, both of Mass.

[21] Appl. No.: 848,435

[22] Filed: Apr. 4, 1986

[51] Int. Cl.[4] ..... H01J 61/20

[52] U.S. Cl. ..... 313/571; 313/642

[58] Field of Search ..... 313/570, 571, 638, 639, 313/642

[56] References Cited

U.S. PATENT DOCUMENTS 3,720,855 3/1973 Gardner et al. ..... 313/571

3,748,520 7/1973 Silver ..... 313/571

OTHER PUBLICATIONS

Metal Oxide Containing High Intensity Discharge Lamp" by Lapatovich et al; 4th International Symposium on Science and Technology of Light Sources 4/7-10/1986.

*Primary Examiner*—Palmer C. DeMeo

*Assistant Examiner*—Sandra L. O'Shea

*Attorney, Agent, or Firm*—Martha Ann Finnegan

[57] ABSTRACT

A fill composition for a high intensity discharge device including mercury, niobium oxytrihalide, and a molecular stabilization agent is provided. The molar ratio of niobium oxytrihalide to the molecular stabilization agent in the fill is in the range of from about 5:1 to about 7.5:1. Niobium oxytrihalide is present in the fill in sufficient amount to produce, by dissociation in the discharge, atomic niobium, niobium oxide, NbO, and niobium dioxide, $NbO_2$, with the molar ratio of niobium-containing vapor species to mercury in the fill being in the range of from about 0.01:1 to about 0.50:1; and mercury pressure of about 1 to about 50 atmospheres at lamp operating temperature. There is also provided a high intensity discharge device comprising a sealed light-transmissive arc tube; the arc tube including the above-described fill; and an energizing means for producing an electric discharge within the arc tube.

20 Claims, 7 Drawing Figures

HIGH INTENSITY DISCHARGE DEVICE CONTAINING OXYTRIHALIDES

The Government has rights to this invention pursuant to Contract DE-AC03 84SF 12235 awarded by the Department of Energy.

BACKGROUND OF THE INVENTION

This invention relates to high intensity discharge devices; and more particularly to fills for use in high intensity discharge devices.

The search for more efficient white light sources is continually driven by engergy concerns. In the past, light sources most commonly used in the home environment have been incadescant bulbs, which are energy inefficient. Recently, use of the more efficient fluorescent lamp has increased in the home environment. Although metal halide arc discharge sources are good white light emitters, these light sources are not generally used in the home environment. Metal halide arc discharges are, however, used extensively in industrial settings. More specifically, high pressure electric discharge lamps containing mercury with sodium and scandium iodides are commercially available and have received wide use in such settings. These sources have high efficacy (80 LPW), good color rendering (color rendition index, CRI=65), and reasonably low color temperature (T=4700). For metal halide arc discharges to be used for general illumination, especially in residential applications, the devices should have comparable efficacy but a warmer color temperature which produces more desirable skin tones.

An example of a high intensity discharge device with improved color is found in U.S. Pat. No. 3,720,855, issued to Gardner et al. on Mar. 13, 1973, which describes an electric discharge lamp containing a fill which includes at least one oxytrihalide of a Group VB element, the partial pressure of the oxytrihalide being in the range of from about 0.001 torr to about 200 torr. However, lamps containing the fill described in the Gardner patent, whether electroded or electrodeless, suffer from short lifetimes due to instability of the discharge.

SUMMARY OF THE INVENTION

In accordance with the present invention, there is provided a high intensity discharge device comprising a sealed light-transmissive arc tube including a fill; said fill comprising mercury, niobium oxytrihalide, and a molecular stabilization agent, the molar ratio of said niobium oxytrihalide to said molecular stabilization agent in the fill being in the range of from about 5:1 to about 7.5:1; said niobium oxytrihalide being present in an amount sufficient to produce, by dissociation in the discharge, atomic niobium, niobium oxide, NbO, and niobium dioxide, $NbO_2$, with the molar ratio of niobium-containing vapor species to mercury in the fill being in the range of from about 0.01 to about 0.50; and said mercury being present in the fill in an amount sufficient to create a partial mercury pressure in the range of from about 1 to about 50 atmospheres at lamp operating temperature; and an energizing means for producing an electric discharge within said arc tube.

In accordance with another aspect of the present invention, there is provided a fill composition for a high intensity discharge device, said fill comprising mercury, niobium oxytrihalide, and a molecular stabilization agent; the molar ratio of said niobium oxytrihalide to said molecular stabilization agent in the fill being in the range of from about 5:1 to about 7.5:1; said niobium oxytrihalide being present in an amount sufficient to produce, by dissociation in the discharge, atomic niobium, niobium oxide, NbO, and niobium dioxide, $NbO_2$, with the molar ratio of niobium-containing vapor species to mercury in the fill being in the range of from about 0.01 to about 0.50; and said mercury being present in the fill in an amount sufficient to create a partial mercury pressure in the range of about 1 to about 50 atmospheres at lamp operating temperature.

BRIEF DESCRIPTION OF THE DRAWINGS

Figure 1:
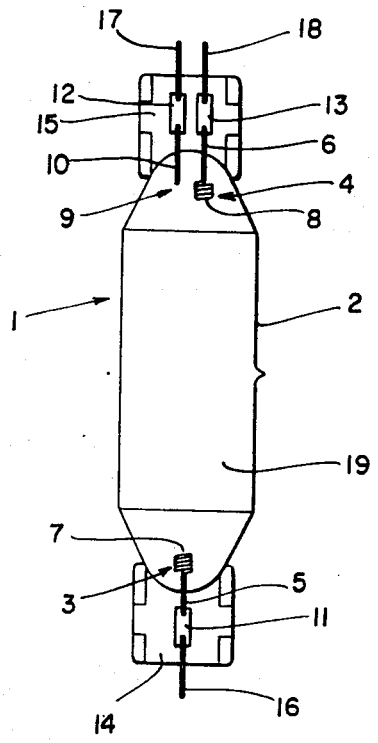

IN THE DRAWINGS:

FIG. 1 is an elevational view of an electric discharge device in accordance with one embodiment of the present invention.

Figure 2:
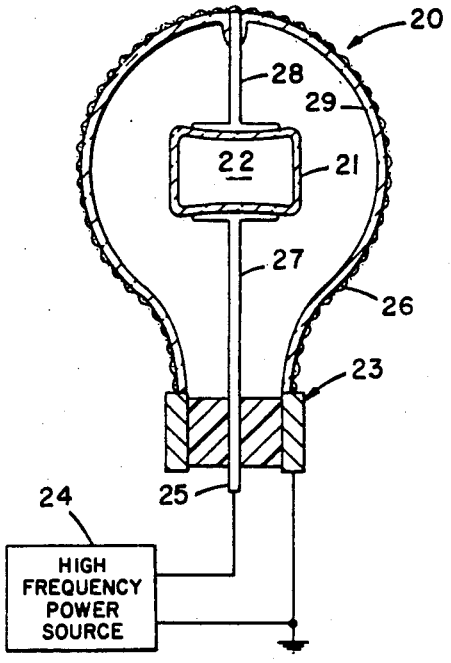

FIG. 2 is a schematic representation of an electrodeless radio frequency coupled discharge light source in accordance with one embodiment of the present invention.

Figure 3:
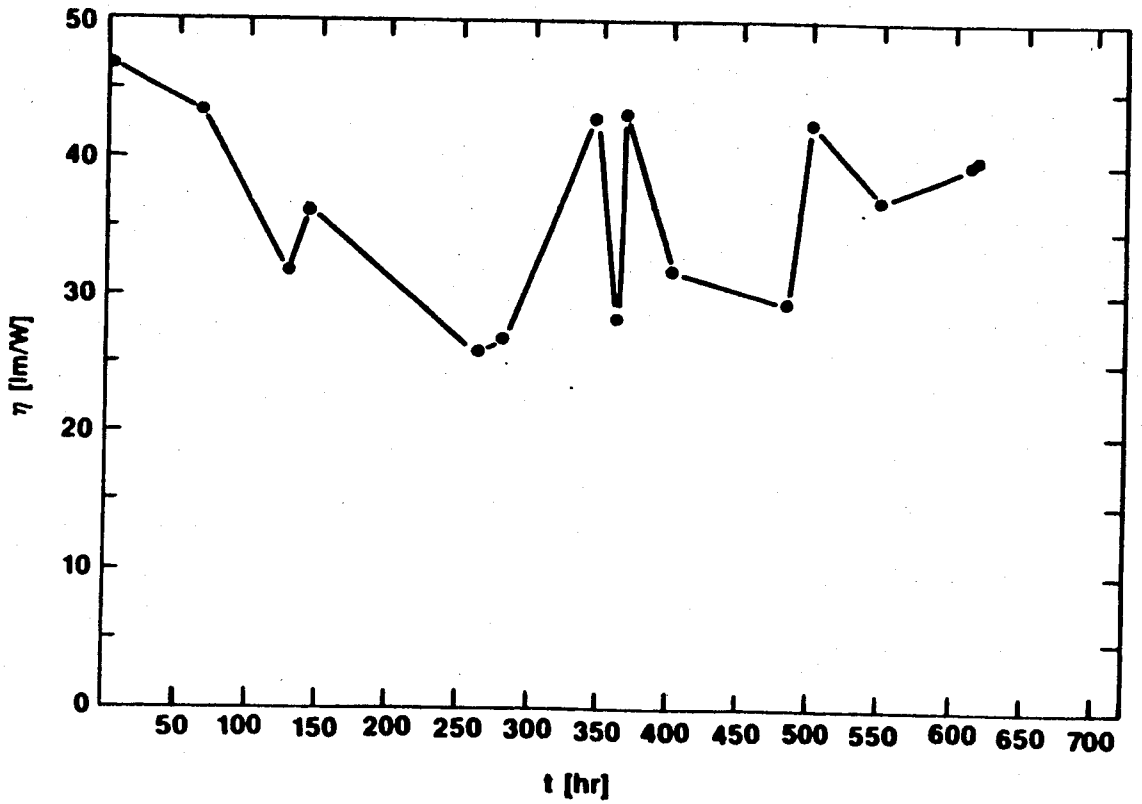

FIG. 3 graphically represents performance data for a lamp fabricated in accordance with the present invention.

Figure 4:
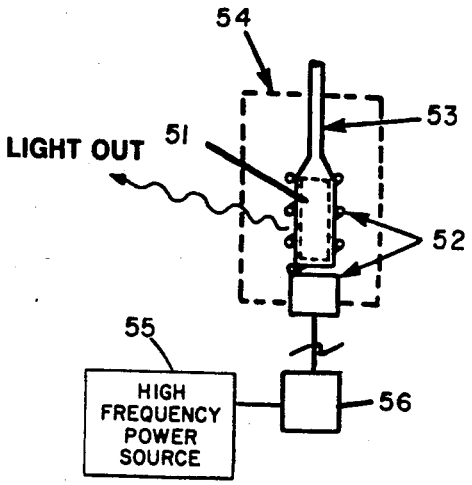

FIG. 4 is a schematic representation of an electromagnetic discharge apparatus.

Figure 5:
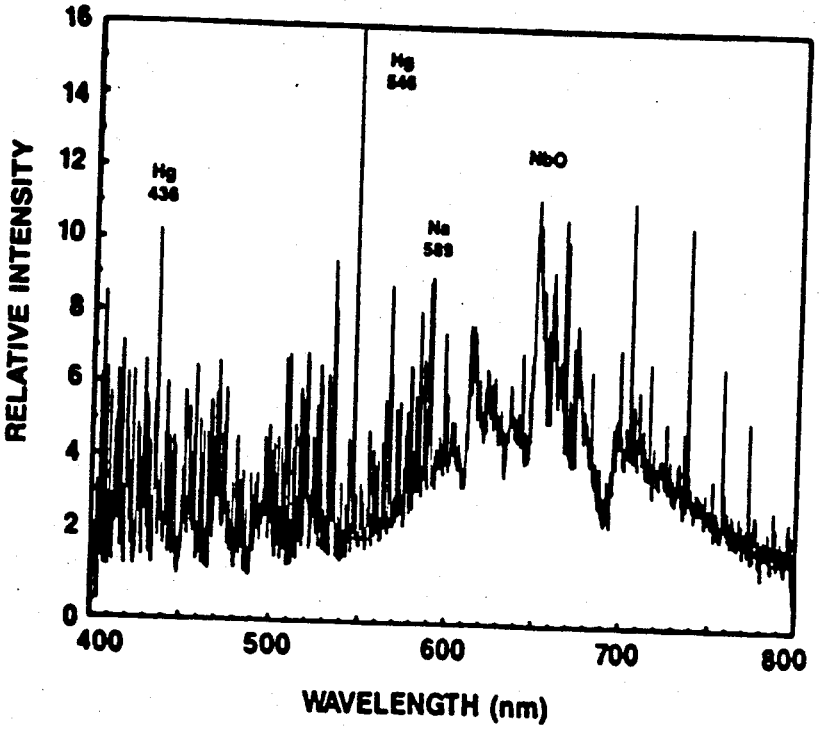

FIG. 5 represents a typical spectral power distribution graph for a lamp fabricated in accordance with the present invention.

Figure 6:
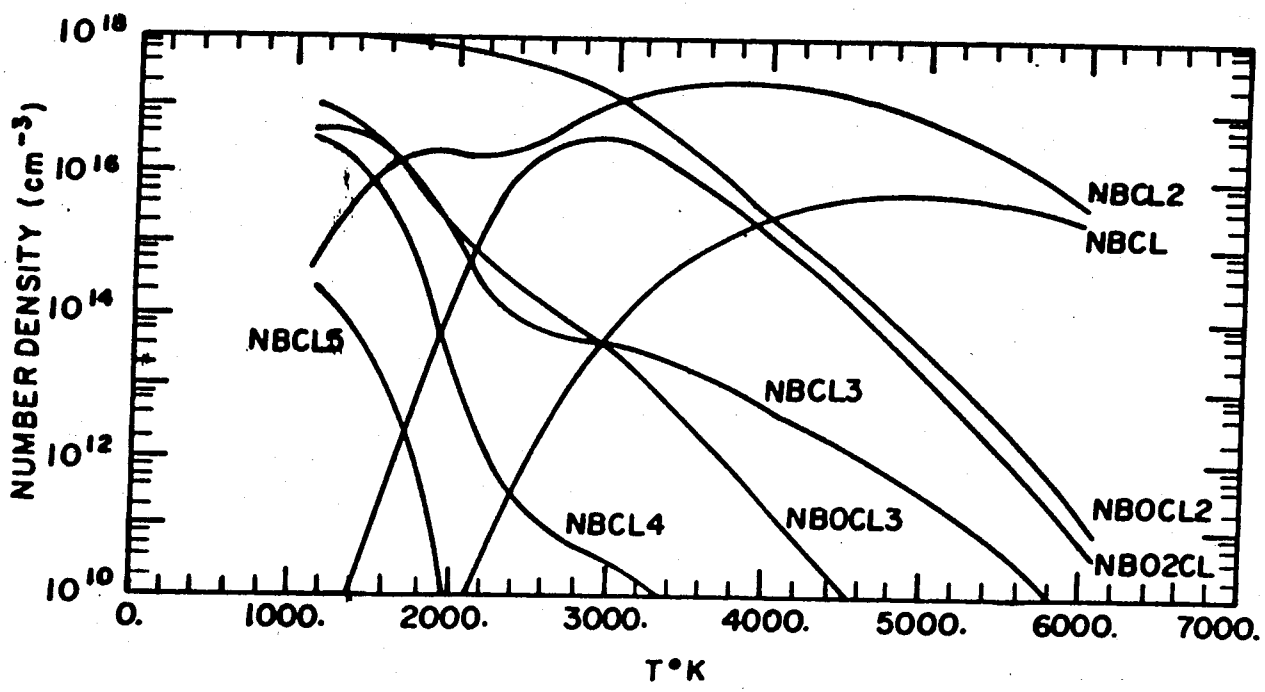

FIG. 6 graphically represents the Number Density (molecules/$cm^3$) as a function of Temperature (Kelvin) for the vaporizing components in a lamp fabricated in accordance with the present invention.

Figure 7:
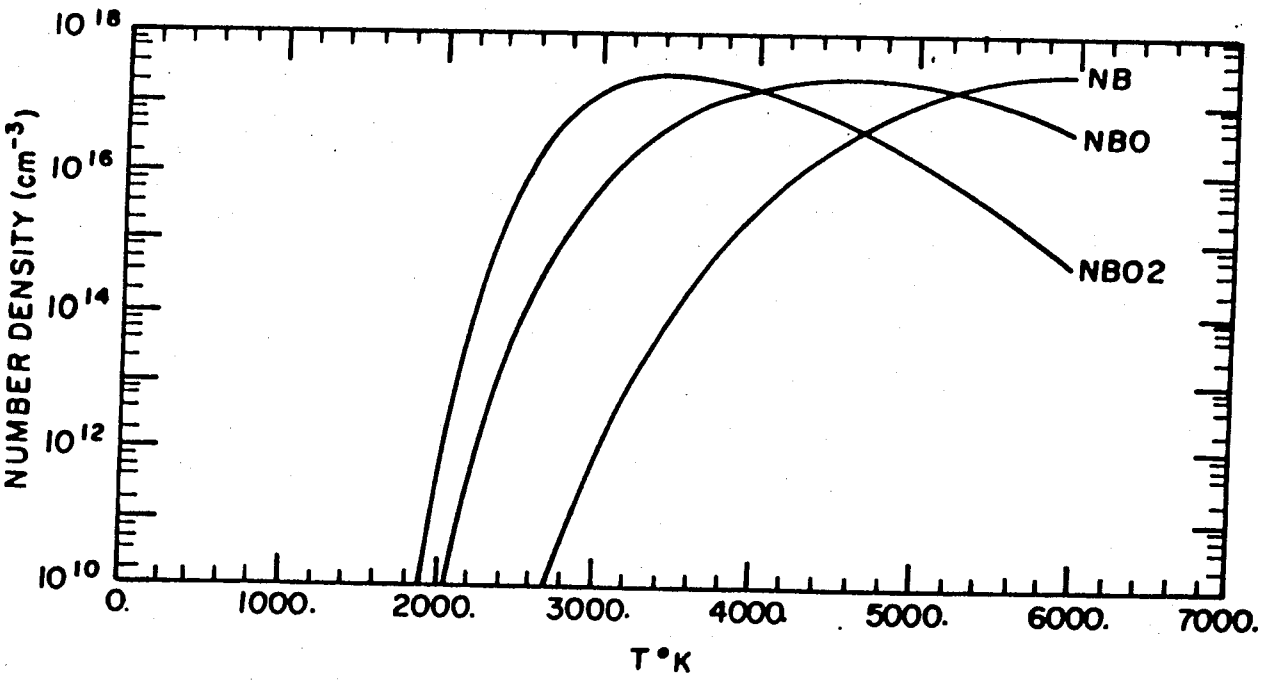

FIG. 7 graphically represents the Number Density (molecules/$cm^3$) as a function of Temperature (Kelvin) for the Radiating Fragments in a lamp fabricated in accordance with the present invention.

For a better understanding of the present invention, together with other and further objects, features, advantages, and capabilities thereof, reference is made to the following discussion and appended claims in connection with the above-described drawings.

DETAILED DESCRIPTION OF THE INVENTION

One embodiment of a high intensity discharge device in accordance with the present invention is illustrated in FIG. 1. The discharge device 1 includes a sealed light-transmissive envelope 2 having main discharge electrodes 3 and 4 at opposite ends thereof. The electrodes 3 and 4 are made of a suitable metal, such as thoriated tungsten or pure tungsten and are supported on lead-in wires 5 and 6, respectively, and have tungsten helices 7 and 8, respectively at their interior ends. An auxiliary starting electrode 9, typically fabricated from tantalum or tungsten, is provided at one end of the envelope 2 adjacent one of the main discharge electrodes 4, and comprises an inwardly projecting end of another lead-in wire 10.

Each of the three current lead-in wires 5, 6, and 10 have their ends welded to intermediate foil sections 11, 12, and 13 respectively, of molybdenum which are hermetically sealed within pinched sealed portions 14 and 15 of the envelope 2. The foil sections are very thin, for example, approximately 0.0008 inch thick, and go into tension without rupturing or sealing off when the heated envelope cools. Molybdenum and tantalum wires 16, 17, and 18 are welded to the outer ends of foils 11, 12, and 13, respectively and serve to convey current to the electrodes inside envelope 2. Inside the envelope 2, there is a volume 19 in which a fill in accordance with the present invention is volatilized. The discharge device 1 of FIG. 1 is typically contained within an outer envelope (not shown).

In another embodiment of a discharge device in accordance with the present invention, the pair of internal electrodes 3 and 4 are eliminated and replaced by radio frequency (RF) or microwave power source. The power source is preferably a source of continuous wave RF excitation in the range of from 902 to 928 MHz, although freguencies of 1 MHz to 10 GHz may be used. An example of an electromagnetic discharge apparatus in accordance with an aspect of the present invention is illustrated in FIG. 2. The apparatus 20 includes an electrodeless lamp 21 containing a fill material 22. The electrodeless lamp 21 is supported within a a coupling fixture 23 which couples power from a high frequency power source 24 to the fill material of the electrodeless lamp. The electrodeless lamp forms a termination load for the fixture 23.

The electrodeless lamp 21 has a sealed envelope made of a suitable material which is transparent to visible light, for example, fused silica, aluminum oxide, or Pyrex. The fill material 22 within the lamp envelope in accordance with the present invention includes mercury, niobium oxytrihalide ($NbOX_3$), and a molecular stabilization agent in the concentrations described herein. The niobium oxytrihalide fill component is preferably selected from the group consisting of niobium oxytrichloride; niobium oxytribromide, niobium oxytriiodide, and mixtures thereof.

The coupling fixture 23 includes an inner conductor 25 and an outer conductor 26 disposed around the inner conductor. The outer conductor 26 includes a conductive mesh which acts as a conductor and provides shielding at the operating frequencies while permitting the passage of light radiated from the lamp 21. The electrodeless lamp 21 is supported between a first metal electrode 27 at one end of the inner conductor 25 and a second metal electrode 28 connected to the outer conductor 26. The other ends of the inner and outer conductors are arranged in a coaxial configuration for coupling to the power source 24. The outer conductive mesh is supported by a transparent envelope 29, which may be of glass.

When high freguency power is applied to an electrodeless lamp 21 containing the fill of the present invention, a discharge is initiated in the rare gas. The power deposited in the rare gas discharge serves to heat the walls to the temperature at which the fill is vaporized. The vaporized fill is excited, and the $NbO_2$, NbO, and Nb formed in the discharge emit visible light. NbO is stable at elevated temperatures (ground state dissociation energy D=7.8 ev) and has a spectrum rich in red.

In operation, the niobium oxytrihalide component of the fill of the present invention breaks down due to the electric discharge and the high temperatures created by the discharge, to yield a niobium dioxide ($NbO_2$) molecule, a niobium oxide (NbO) molecule, or a niobium metal atom. At the same time, free halogen and oxygen are also formed. No niobium oxide deposits are found on the cooler portions of the envelope wall since both niobium oxide and niobium metal atoms react with the free halogen and oxygen to regenerate niobium oxytrihalide. Niobium oxytrihalide is maintained in the vapor state because of its high vapor pressure at the lamp operating temperature. Niobium oxytrihalides include niobium oxytrifluoride, niobium oxytrichloride, niobium oxytriiodide, niobium oxytribromide, and mixtures thereof. The niobium oxytrihalide fill component is preferably selected from $NbOCl_3$, $NbOBr_3$, $NbOI_3$, and mixtures thereof.

The niobium oxytrihalide precursor is a highly volatile molecule which gives rise to fragmentation products which emit useful radiation and which fragments are stable at the arc temperature. Niobium oxytrihalide and the fragmentation products thereof will react to some extent with the arc tube components.

Preferably the niobium oxytrihalide is generated or formed in the arc tube envelope in the electric discharge. Niobium oxytrihalide can be generated from ultrapure niobium metal foil and various halogen and oxygen donors such as $HgCl_2$ and HgO. Most preferably niobium oxytrihalide is generated through the reaction:

$$4NbOX_2+2NbX_5+2HgO+[MSA]\rightarrow 6NbOX_3+2Hg+[MSA]$$

In the foregoing reaction, [MSA] represents the molecular stabilization agent.

In accordance with the foregoing an $NbOCl_3$ precusor is most preferably generated through the reaction:

$$4NbOCl_2+2NbCl_5+2HgO+2HgI_2\rightarrow 6NbOCl_3+2Hg+2HgI_2,$$

wherein $HgI_2$ is the molecular stabilization agent.

The desired radiating fragments of $NbOX_3$, namely, Nb, NbO, and $NbO_2$, are produced by collisional dissociation in the discharge. These fragments are subseguently excited by further electron impact, producing excited states which radiate useful visible radiation.

The fill of the present invention also contains a volatile molecular stabilization agent. The molecular stabilization agent is a high vapor pressure metal halide which does not participate in the in situ formation of the volatile niobium oxyhalide such as mercury iodide. A high vapor pressure metal halide is a metal halide which has a vapor pressure of at least 0.1 atmosphere (atm) under typical lamp cold spot operating temperatures of about 600° C. to about 1000° C. Preferably the metal halide has a vapor pressure of about 0.1 atm to 0.5 atm. Examples of high vapor pressure metal halides suitable for use as molecular stabilization agents in the fill of the present invention include mercuric iodide, mercuric bromide, mercuric chloride, and the bromide, chloride, and iodide salts of aluminum and ga11ium. The molecular stabilization agent can also be a mixture of high vapor pressure metal halides. The molecular stabilization agent closes the halogen cycles so as to prevent untimely, or premature decomposition of the desired $NbOX_3$ precursor and of the NbO and $NbO_2$ radiating species. The molecular stabilization agent prevents $NbOX_3$ from reacting with other halide materials which may be optionally included in the fill. A high vapor pressure metal halide molecular stabilization agent, such as $HgX_2$ (wherein X represents the halogen), provides a high vapor pressure of the metal halide to dominate halide reactions in the fill.

In electroded devices, high pressure metal iodides are preferred for use as molecular stabilization agents because iodides are less corrosive to the electrodes than metal chlorides and metal bromides.

In the fill of the present invention, the molar ratio of the niobium oxytrihalide molecular stabilization agent in the fill is in the range of about 5:1 to about 7.5:1. The molecular stabilization agent enables these discharge devices to run continuously over extended periods of time. In lamps containing fills which included no molecular stabilization agent, the discharge was not temporally or spatially stable i.e., each discharge would last for a few seconds and then extinguish. Stability of the discharge was achieved by the addition of a high vapor pressure molecular stabilization agent at the above-described concentration level. The molecular stabilization agent does not participate in the formation of the active radiating species.

Preferably, excess elemental niobium in the form of, for example, a metallic niobium chip, niobium powder, or niobium micropsheres, is further included in the lamp fill to act as a source of excess niobium should wall reactions deplete the NbO or $NbO_2$ provided by dissociation of the $NbOCl_3$ component of the fill. The molar ratio of the excess elemental niobium to niobium oxytrihalide in the fill is at least 0.23:1. Most preferably, the molar ratio is from about 0.23:1 to about 2.33:1. For example in an arc tube with a volume of 3.4 $cm^3$, the niobium chip should have a weight of at least about 0.1 milligrams. Most preferably, the niobium chip should have a weight in the range of from about 0.1 to about 1.0 mg.

In the fill of the present invention, the molar ratio of the niobium-containing vapor species produced by the niobium oxytrihalide to mercury is in the range of about 0.01 to about 0.50. Preferably the molar ratio of the niobium-containing vapor species produced by the niobium oxytrihalide component of the fill (including niobium produced by the oxytrihalide) to Hg is about 0.12. The molar ratio of niobium oxytrihalide to the molecular stabilization agent in the fill of the present invention is in the range of about 5:1 to about 7.5:1, with a preferred ratio of about 6:1 to about 6.5:1. Most preferably, the ratio is abouut 6.3:1. The total mercury dosage should be selected to create a partial mercury pressure in the range of about 1 to about 50 atmospheres at lamp operating temperature. The fill also contains a rare gas, such as argon, at typical partial pressures from about 5 to about 100 torr.

Alkali metal halides e.g. chloride, bromides, iodides, and mixtures thereof, may optionally be added to the fill of a metal halide arc discharge device. Cesium halide may be added to provide a source of easily ionized material, i.e., cesium atoms which increases the arc diameter. Sodium halide may be added to provide sodium atoms, which are less easily ionized than cesium. The sodium atoms contribute substantial atomic radiation near 590 nm. The molar ratio of cesium to sodium in the fill of the present invention is in the range of about 0.1 to 10.0, with a preferred ratio of about 1.0. The nobium to alkali molar ratio is in the range of about 1.0 to about 10.0 with a preferred value of about 3.3. The niobium to mercury molar ratio is within the range of about 0.01 to about 0.40 with a preferred value of about 0.12.

Both electrodeless and electroded lamps have been fabricated containing a fill in accordance with the present invention. Lamps of both types, including fills in accordance with the present invention, can be started repeatedly and maintain a closed halogen cycle. The fill gives rise to both electroded and electrodeless lamps having good efficacy, high color rendition, and warm color temperature. Typical results for discharge devices in accordance with the present invention are summarized in Table I below.

TABLE I

| | 175 Watt Electroded $NbOCl_3$ Lamp with Sodium | Electrodeless Microwave Discharge Lamp (same fill) |
|---|---|---|
| Wall loading (Watts/$cm^2$) | 27.7 | 26.7 |
| Efficacy (lumen/watt) | 72.9 | 60 |
| CRI | 94.2 | 82 |
| Correlated Color Temperature (K) | 6263 | 3740 |

The sodium in the fill increases the luminous efficacy and lowers the color temperatures because of the strong D line emission near 589 nanometer (nm) and the resonance line broadening at the high pressures. The NbO radiating specie balances the lamp color through molecular transitions further in the red spectral region.

The following Examples are given to enable those skilled in this art to more clearly understand and practice the present invention. These Examples should not be considered as a limitation upon the scope of the invention but merely as being illustrative and representative thereof.

EXAMPLE I

An envelope with a volume of 3.4 $cm^3$ was filled with 0.55 milligram (mg) $NbOCl_2$, 0.42 mg $NbCl_5$, 0.34 mg HgO, 0.35 mg $HgI_2$, 7.5 mg Hg, 2.0 mg CsI and 5 torr argon. Input power was bout 305 watts and the temperature 830° C. The discharge was bluish white, with a red mantle. This discharge device was an electrodeless lamp.

EXAMPLE II

An envelope with a volume of 3.4 $cm^3$ was filled with 7.5 mg Hg, 0.35 mg $HgI_2$, 0.34 mg HgO, 0.42 mg $NbCl_5$, 0.55 mg $NbOCl_2$, 2.0 mg CsI, 1.15 mg NaI and 5 torr argon. Measurements for this electrodeless device at various input power levels are tabulated below:

| Pi (W) | Pr (W) | Pc (W) | TEMP | LUMENS | lm/W | W/$cm^2$ | W/$cm^3$ | CRI | Tcc (K) |
|---|---|---|---|---|---|---|---|---|---|
| 340.0 | 60.0 | 280.0 | 815.0 | 15100.0 | 53.9 | 20.6 | 82.6 | 80.9 | 3819 |
| 450.0 | 90.0 | 360.0 | 910.0 | 19500.0 | 54.2 | 26.5 | 106.2 | — | — |
| 430.0 | 68.0 | 362.0 | 895.0 | 20550.0 | 56.8 | 26.7 | 106.8 | 81.9 | 3739 |

The discharge color varies with power—ranging from bluish-white to white, all with a distinct red mantle.

EXAMPLE III

An envelope with a volume of 3.4 $cm^3$ was filled with 7.5 mg Hg, 0.35 mg $HgI_2$, 0.34 mg HgO, 0.42 mg $NbCl_5$, 0.55 mg $NbOCl_2$, 2.0 mg CsI, 1.15 mg NaI, and 5 torr argon. The discharge was as described earlier. The spectra showed predominantly molecular emission; lines characteristic of Nb were also visible.

The following measurements were obtained for the device of this example.

| ELAPSED TIME (hours) | Pi (W) | Pr (W) | Pc (W) | TEMP | LUMENS | lm/W | W/cm$^2$ | W/cm$^3$ |
|---|---|---|---|---|---|---|---|---|
| 0.5 | 400.0 | 80.0 | 320.0 | 925.0 | 14100.0 | 44.1 | 23.6 | 94.4 |
| 2 | 350.0 | 58.0 | 292.0 | 845.0 | 9659.0 | 46.6 | 21.48 | 86.14 |
| 65 | 335.0 | 30.0 | 305.0 | 880.0 | 13250.0 | 43.4 | 22.5 | 90.0 |

The maximum peaks at both 0.5 hours and 2.0 hours were approximately 5461, 5890, 5896, and 6710 Angstroms.

EXAMPLE IV

An envelope with a volume of 3.4 cm$^3$ was dosed with a fill composition identical to that described in Example III. The lamp was operating for varying lengths of time, typically over night for a number of days. The total run time logged on the lamp was 616 hours at which time end of life was achieved. The failure appeared to be due to a hairline crack in the quartz envelope which developed after the lamp cooled following a normal power cessation. During the lamp runs, lumen data and wall temperatures were monitored with lumen meter and an infrared pyrometer, respectively. These data are graphically presented in FIG. 3, which shows lumens/watt as a function of time (in hours).

The electrodeless (also referred to as RF) lamps described in the foregoing Examples were fabricated from 2 mm thick General Electric type 214A (water free) quartz. The lamps were cylindrical in shape, approximately 12 mm in diameter and 30 mm in length. Each lamp was baked for several hours while maintaining a vacuum of $10^{-6}$ torr in the vessel. The components of the fill were ultrapure anhydrous compounds or metals and were introduced into the lamp in a dry box under argon atmosphere. (The argon atmosphere contained less than 2 ppm moisture.) The dry box atmosphere was evacuated on a turbomolecular serviced backfill system, and the final gas, such as 99.999% argon was introduced at the selected pressure. The vessels were permanently sealed with a hydrogen torch.

A schematic illustration of the electromagnetic discharge apparatus used in the foregoing Examples is illustrated in FIG. 4. Referring to FIG. 4, the electrodeless lamp 51 was suspended within an RF helical coil termination fixture 52 by means of an attached quartz tube 53. The quartz tube served as the evacuation port prior to tip off with the hydrogen flame. The discharge was initiated in the lamp by means of a Telsa coil and wire probe (not shown) which was temporarily inserted into the guartz tip-off tube. The termination fixtures including the guartz tube 53 was surrounded by a grounded mesh shield 54. The RF power source 55 (915 MHZ) was increased until a discharge was sustained in the cylindrical lamp. The starting wire was then withdrawn and the RF power was increased as the discharge developed from the glow into an arc. When the discharge had stabilized into an arc, the in-line tuner 56 was adjusted to minimize the reflected power due to the load (discharge) mismatch.

The radiation from the discharge was gathered by several mirrors onto a barium sulfate coated scatter plate. The scatter plate was used because it permits sampling radiation from all portions of the source. The scattered radiation was input into a 0.5 m scanning monochrometer, where the spectral components were detected using a Hamamatsu R955 photomultiplier. The detected signal was amplified and digitized by a microcomputer. The digitized spectral power distribution was corrected for instrumental response and used to calculate correlated color temperature, $T_{cc}$; chromaticity coordinates, x and y; and color rendition index, CRI or $R_a$.

Because the corrected spectral data are relative and not absolute, luminous efficacy was not calculated from the spectral power distribution. Lumen measurements were made with a calibrated foot candle meter. The luminous efficacy in the case of the electrodeless lamps, is defined as the lumen output divided by the coupled RF power in watts. Coupled RF power is the difference between the forward and reflected power. Examples of typical operating parameters for electrodeless lamps in accordance with the present invention are given in Table II.

TABLE II

| | | |
|---|---|---|
| RF power in | 430 W | 485 W |
| RF power reflected | 68 W | 113 W |
| RF power coupled | 362 W | 372 W |
| Equivalent wall loading 26.7 W/Cm$^2$ | | |
| Wall temperature | 895 C | 790 C |
| Energy density | 106.8 W/cm$^3$ | 109.8 W/cm$^3$ |
| Lumens | 20550 1 m | 225001 m |
| Efficacy | 56.8 1 m/W | 60.51 m/W |
| Color rendition index | 81.9 | 83.8 |
| Correlated Color Temperature | 3739 K | 4496 K |

EXAMPLE V

An electroded lamp, having a volume of 3.95 cm$^3$ and an arc tube wall area of 14.1 cm$^2$, was fabricated having the following fill:

| | |
|---|---|
| Hg | 13.0 mg |
| $HgI_2$ | 0.69 mg |
| HgO | 0.59 mg |
| $NbCl_5$ | 0.73 mg |
| $NbOCl_2$ | 0.96 mg |
| CsI | 3.47 mg |
| NaI | 2.0 mg |
| Argon | about 40 torr. |

Examples of typical operating parameters for electroded lamps in accordance with the present invention are given in Table III.

TABLE III

| | | |
|---|---|---|
| Voltage (volts) | 151.6 | 154 |
| Current (amps) | 2.54 | 3.06 |
| Power (watts) | 301.7 | 390.6 |
| Wall loading (watts/cm$^2$) | 21.4 | 27.7 |
| Energy density (watts/cm$^3$) | 76.4 | 98.9 |
| Lumens | 19,127.8 | 28,474.7 |
| Efficacy (lumens/watt) | 63.4 | 72.9 |
| Color redition index | 93.8 | 94.2 |
| Correlated Color | | |

TABLE III-continued

| Temperature (Kelvin) | 6835 | 6263 |
|---|---|---|

A typical spectral power distribution (spd) is shown in FIG. 5. The spd is corrected for instrumental response. Unambiguous vibronic bands of the NbO molecule in the red portion of the spectrum were identified. Assignments were made to NbO, A, B, C, D, E→X, and tentarive assignments for A', F'→X transitions. For example, the strong molecular band edge near 610 nm is due to the D→X transition (650 nm due to C→X, etc.).

FIGS. 6 and 7 reflect the Number Density (molecules/$cm^3$) as a function of the temperature of the plasma (expressed in degrees Kelvin) for a typical lamp in accordance with the present invention during operation when the fill is fully equilibrated. FIG. 6 represents the number density for the vaporizing components as a functiion of plasma temperature. The data contained in FIGS. 6 and 7 were obtained from a device having a fill including $NbOCl_3$, Hg, $HgI_2$, Ar, NaI, and CsI at a total gas pressure of 4.55 atmospheres.

While there have been shown and described what are considered preferred embodiments of the present invention it will be obvious to those skilled in the art that various changes and modifications may be made therein without departing from the invention as defined by the appended claims.

What is claimed is:

1. A high intensity discharge device comprising a sealed light-transmissive arc tube, said arc tube including a fill; said fill comprising mercury, niobium oxytrihalide, and a molecular stabilization agent, the molar ratio of said niobium oxytrihalide to molecular stabilization agent in the fill being in the range of from about 5:1 to about 7.5:1; said niobium oxytrihalide being present in sufficient amount to produce, by dissociation in the discharge, atomic niobium, niobium oxide, NbO, and niobium dioxide, $NbO_2$, with the molar ratio of niobium-containing vapor species to mercury in the fill being in the range of from about 0.01 to about 0.50, and said mercury being present in the fill in an amount sufficient to create a partial mercury pressure in the range of from about 1 to about 50 atmospheres at lamp operating temperature; and an energizing means for producing an electric discharge within said arc tube.

2. A high intensity discharge device in accordance with claim 1 wherein said niobium oxytrihalide is selected from the group consisting of niobium oxytrichloride, niobium oxytribromide, niobium oxytriiodide and mixtures thereof.

3. A high intensity discharge device in accordance with claim 2 wherein the molecular stabilization agent is a high vapor pressure metal halide with a vapor pressure of at least 0.1 atmosphere at lamp cold spot operating temperatures of about 600° to about 1000° C.

4. A high intensity discharge device in accordance with claim 3 wherein the molecular stabilization agent is selected from the group consisting of mercuric chloride, mercuric bromide, mercuric iodide, aluminum chloride, aluminum bromide, aluminum iodide, gallium chloride, gallium bromide, gallium iodide, and mixtures thereof.

5. A high intensity discharge device in accordance with claim 4 wherein the molar ratio of niobium oxytrihalide to molecular stabilization agent is in the range of about 6:1 to 6.5:1.

6. A high intensity discharge device in accordance with 5 wherein said fill further comprises excess niobium, the molar ratio of niobium to niobium oxytrihalide in the fill being at least 0.23:1.

7. A high intensity discharge device in accordance with claim 6 wherein said excess niobium is in the form of a metallic niobium chip, the molar ratio of niobium to niobium oxytrihalide in the fill being in the range of from about 0.23:1 to about 2.33:1.

8. A high intensity discharge device in accordance with claim 6 wherein said fill further comprises sodium halide and cesium halide, the molar ratio of cesium to sodium in the fill being in the range of about 0.1:1 to 10:1; and the molar ratio of niobium to (sodium plus cesium) being in the range of about 1:1 to about 10:1.

9. A high intensity discharge device comprising a sealed light-transmissive arc tube, said arc tube including a fill; said fill comprising mercury, niobium oxytrichloride, a molecular stabilizing agent consisting of mercuric iodide, a metallic niobium chip, the molar ratio of said metallic niobium chip to niobium oxytrichloride in the fill being in the range of from about 0.23:1 to about 2.33:1; cesium iodide; sodium iodide; and from about 5 to about 100 torr argon; the molar ratio of said niobium oxytrichloride to mercuric iodide being in the range of from about 6:1 to 6:5.1; said niobium oxytrichloride being present in sufficient amount to produce, by dissociation in the discharge, atomic niobium, niobium oxide, NbO, and niobium dioxide, $NbO_2$, with the molar ratio of niobium-containing vapor species to mercury in the fill being in the range of from about 0.1 to about 0.50; said mercury being present in the fill in an amount sufficient to create a partial mercury pressure in the range of from about 1 to about 50 atmospheres at lamp operating temperature; the molar ratio of cesium to sodium in the fill being in the range of from about 0.1:1 to 10:1 and the molar ratio of niobium to (sodium plus cesium) being in the range of from about 1:1 to about 10:1; and an energizing means for producing an electric discharge within said arc tube.

10. A high intensity discharge device in accordance with claim 9 wherein the molar ratio of niobium oxytrichloride to mercuric iodide is 6.3:1.

11. A fill composition for a high intensity discharge device said fill comprising mercury, niobium oxytrihalide and a molecular stabilization agent, the molar ratio of said niobium oxytrihalide to molecular stabilization agent in the fill being in the range of from about 5:1 to about 7.5:1; said niobium oxytrihalide being present in sufficient amount to produce, by dissociation in the discharge, atomic niobium, niobium oxide, NbO, and niobium dioxide, $NbO_2$, with the molar ratio of niobium-containing vapor species to mercury in the fill being in the range of from about 0.01:1 to about 0.50:1 and said mercury being present in an amount sufficient to create a partial mercury pressure in the range of from about 1 to about 50 atmospheres at lamp operating temperature.

12. A fill composition for a high intensity discharge device in accordance with claim 11 wherein said niobium oxytrihalide is selected from the group consisting of niobium oxytrichloride, niobium oxytribromide, niobium oxytriiodide and mixtures thereof.

13. A fill composition for a high intensity discharge device in accordance with claim 12 wherein the molecular stabilization agent is a high vapor, pressure metal halide with a vapor pressure of at least 0.1 atmosphere at lamp cold spot operting temperatures of about 600° to about 1000° C.

14. A fill composition for a high intensity discharge device in accordance with claim 13 wherein the molecular stabilization agent is selected from the group consisting of mercuric chloride, mercuric bromide, mercuric iodide, aluminum chloride, aluminum bromide, aluminum iodide, gallium chloride, gallium bromide, gallium iodide, and mixtures thereof.

15. A fill composition for a high intensity discharge device in accordance with claim 14 wherein the molar ratio of niobium oxytrihalide to molecular stabilization agent is in the range of about 6:1 to 6.5:1.

16. A fill composition for a high intensity discharge device in accordance with 15 wherein said fill further comprises excess niobium, the molar ratio of excess niobium to niobium oxytrihalide in the fill being at least about 0.23:1.

17. A fill composition for a high intensity discharge device in accordance with claim 16 wherein said excess niobium is in the form or a metallic niobium chip, the molar ratio of said metallic niobium chip to niobium oxytrihalide in the fill being in the range of from about 0.23:1 to about 2.3:1.

18. A fill composition for a high intensity discharge device in accordance with claim 16 wherein said fill further comprises a sodium halide and cesium halide, the molar ratio of cesium to sodium in the fill being in the range of about 0.1:1 to 10:1; and the molar ratio of niobium to (sodium plus cesium) being in the range of about 1:1 to about 10:1.

19. A fill composition for a high intensity discharge device comprising mercury, niobium oxytrichloride a molecular stabilizing agent consisting of mercuric iodide, a metallic niobium chip, cesium iodide; sodium iodide; and about 5 to about 100 torr argon; the molar ratio of said niobium oxytrichloride to mercuric iodide being in the range of from about 6:1 to 6:5.1; said niobium oxytrichloride being present in sufficient abount to produce, by dissociation in the discharge, atomic niobium, niobium oxide, NbO, and niobium dioxide, $NbO_2$, with the molar ratio of niobium-containing vapor species to mercury in the fill being in the range of from about 0.1 to about 0.50; said mercury being present in the fill in an amount sufficient to create a partial mercury pressure in the range of from about 1 to about 50 atmospheres at lamp operating temperature; the ratio of cesium to sodium in the fill being in the range of from about 0.1:1 to 10:1 and the molar ratio of niobium to (sodium plus cesium) being in the range of from about 1:1 to about 10:1.

20. A fill composition for a high intensity discharge device in accordance with claim 19 wherein the molar ratio of niobium oxytrichloride to mercuric iodide is 6.3:1.

* * * * *